US006293343B1

(12) United States Patent
Pallini, Jr. et al.

(10) Patent No.: US 6,293,343 B1
(45) **Date of Patent: *Sep. 25, 2001**

(54) EXTERNAL TIEBACK CONNECTOR AND METHOD FOR TYING BACK RISER TO SUBSEA WELLHEAD

(75) Inventors: Joseph W. Pallini, Jr., Tomball; Rockford D. Lyle, Pinehurst, both of TX (US)

(73) Assignee: ABB Vetco Gray, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/803,618

(22) Filed: Mar. 8, 2001

Related U.S. Application Data

(63) Continuation of application No. 09/275,345, filed on Mar. 24, 1999, now Pat. No. 6,234,252.

(60) Provisional application No. 60/079,385, filed on Mar. 26, 1998.

(51) Int. Cl.[7] ..... E21B 33/038; E21B 43/01

(52) U.S. Cl. ..... 166/345; 166/348; 166/359; 285/18; 285/123.1; 285/315

(58) Field of Search ..... 166/345, 348, 166/359, 368; 285/18, 123.1, 315, 920; 405/224, 224.1, 224.4

(56) References Cited

U.S. PATENT DOCUMENTS

| | | | | |
|---|---|---|---|---|
| 3,321,217 | * | 5/1967 | Ahlstone | 285/18 |
| 4,057,267 | * | 11/1977 | Jansen, Jr. | 285/18 |
| 4,153,278 | * | 5/1979 | Ahlstone | 285/18 |
| 4,433,859 | * | 2/1984 | Driver et al. | 285/315 X |
| 4,491,345 | * | 1/1985 | Regan | 285/18 |
| 4,496,172 | * | 1/1985 | Walker | 285/315 X |
| 4,526,406 | * | 7/1985 | Nelson | 285/315 X |
| 4,693,497 | * | 9/1987 | Pettus et al. | 285/315 X |
| 4,696,493 | | 9/1987 | Brammer . | |
| 4,708,376 | * | 11/1987 | Jennings et al. | 285/315 |
| 4,819,967 | | 4/1989 | Calder et al. . | |
| 4,893,842 | | 1/1990 | Brammer . | |
| 5,222,560 | | 6/1993 | Brammer et al. . | |
| 5,255,746 | | 10/1993 | Bridges . | |
| 5,299,642 | | 4/1994 | Nelson et al. . | |
| 5,368,335 | | 11/1994 | Dinnes . | |
| 5,522,681 | * | 6/1996 | Pallini, Jr. | 405/224 X |
| 5,566,761 | | 10/1996 | Pallini, Jr. et al. . | |
| 5,971,076 | * | 10/1999 | Taylor et al. | 166/368 |
| 6,035,938 | * | 3/2000 | Watkins | 166/345 |
| 6,070,669 | * | 6/2000 | Radi et al. | 166/368 |
| 6,234,252 | * | 5/2001 | Pallini, Jr. et al. | 166/345 |
| 6,237,964 | * | 5/2001 | Ostergaard | 285/85 |

FOREIGN PATENT DOCUMENTS

| | | | | |
|---|---|---|---|---|
| 552525-A1 | * | 7/1993 | (EP) | 166/348 |

* cited by examiner

*Primary Examiner*—David Bagnell
*Assistant Examiner*—Jong-Suk Lee
(74) *Attorney, Agent, or Firm*—Bracewell & Patterson, L.L.P.

(57) ABSTRACT

A connector for tying back a riser from a subsea wellhead to a platform, wherein the wellhead has an internal wellhead housing with external grooves thereon. The connector having a plurality of dog members carried within a cavity which engage the external grooves. The dog members are actuated by axial movement of a piston linked to a cam ring. The connector has a plurality of transfer members located within the cavity to support the dog members and transfer upward loading to the wellhead housing during tension on one side due to bending. Further, the connector has a release ring which forces the dog members out of engagement with the external grooves when the connector is released.

21 Claims, 2 Drawing Sheets

EXTERNAL TIEBACK CONNECTOR AND METHOD FOR TYING BACK RISER TO SUBSEA WELLHEAD

CROSS-REFERENCE TO RELATED APPLICATIONS

This application is a continuation of application Ser. Pat. No. 09/275,345, filed Mar. 24, 1999 U.S. No. 6,234,252, which claimed priority from provisional application Ser. No. 60/079,385, filed Mar. 26, 1998.

TECHNICAL FIELD

This invention relates in general to offshore drilling and production equipment and in particular to a tieback system for connecting a subsea well to a platform.

BACKGROUND ART

One type of tie of subsea well employs a wellhead housing located at the sea floor and a drilling blowout preventer or production Christmas tree located at the surface on a platform. Large diameter casing will be lowered from the platform and connected to the wellhead housing with a tieback connecter. The tieback connector must withstand various loading conditions it may see during extended operation. Particularly with a tensioned leg or spar platform where the upper end of the riser is permitted to move horizontally, a bending moment is produced at the wellhead. This may occur even with a fixed platform where there is significant current force acting on the riser. The connection to the wellhead must also be capable of carrying substantial vertical force either in compression where insufficient load is carried by the platform or in tension where excessive load is carried by the platform. Thermal expansion of various components of this structure also occurs, depending on whether or not the well is producing at a particular time and the temperature of the fluid being produced. Furthermore, the riser must endure these stresses through many cycles over many years.

One type of connector has a downward facing funnel that slides over the wellhead housing. It has a body with a connector device which contacts grooves or threads formed on the wellhead housing. A running tool or internal hydraulic cylinders actuate the connector device and joins the riser and wellhead housing. The connector is locked in this position by bolts and various other bolts are in the load path. When released, this type of tieback connector does not have a mechanism to actively release the connector device from the wellhead grooves.

While successful, improvements are desired for tieback connectors wherein large bending forces may be exerted, such as with tension leg platforms or spars.

SUMMARY OF THE INVENTION

The present invention is directed to a device for tying back a riser from a platform to a subsea wellhead housing which can resist high separation and bending loads and is resistant to fatigue from cyclic loading. A connector having features of the present invention comprises a connector body adapted to join to the riser for landing on an upper end of the wellhead housing. A connector housing for insertion over the wellhead housing, depends from the connector body. The connector housing carries more than one dog for mating with and locking in the external grooves. A transfer member is carried in the connector housing in engagement with the dogs and the connector housing for transferring axial loads between the connector housing and the wellhead housing. A piston within the connector housing is linked to an annular cam ring adapted to force the dog members inward into engagement with the external grooves. Both the annular cam ring and piston are adapted to reciprocate axially in the cavity.

The connector may further comprise a release ring which forces the dogs out of engagement when the piston is moved from a downward position upward. The transfer member may be comprised of more than one transfer link, each link having an upper end in engagement with a lower end of one dog and a lower end pivotally engaging the connector housing. Further the transfer member may be below the cam ring.

BEST MODE FOR CARRYING OUT THE INVENTION

Figure 1:
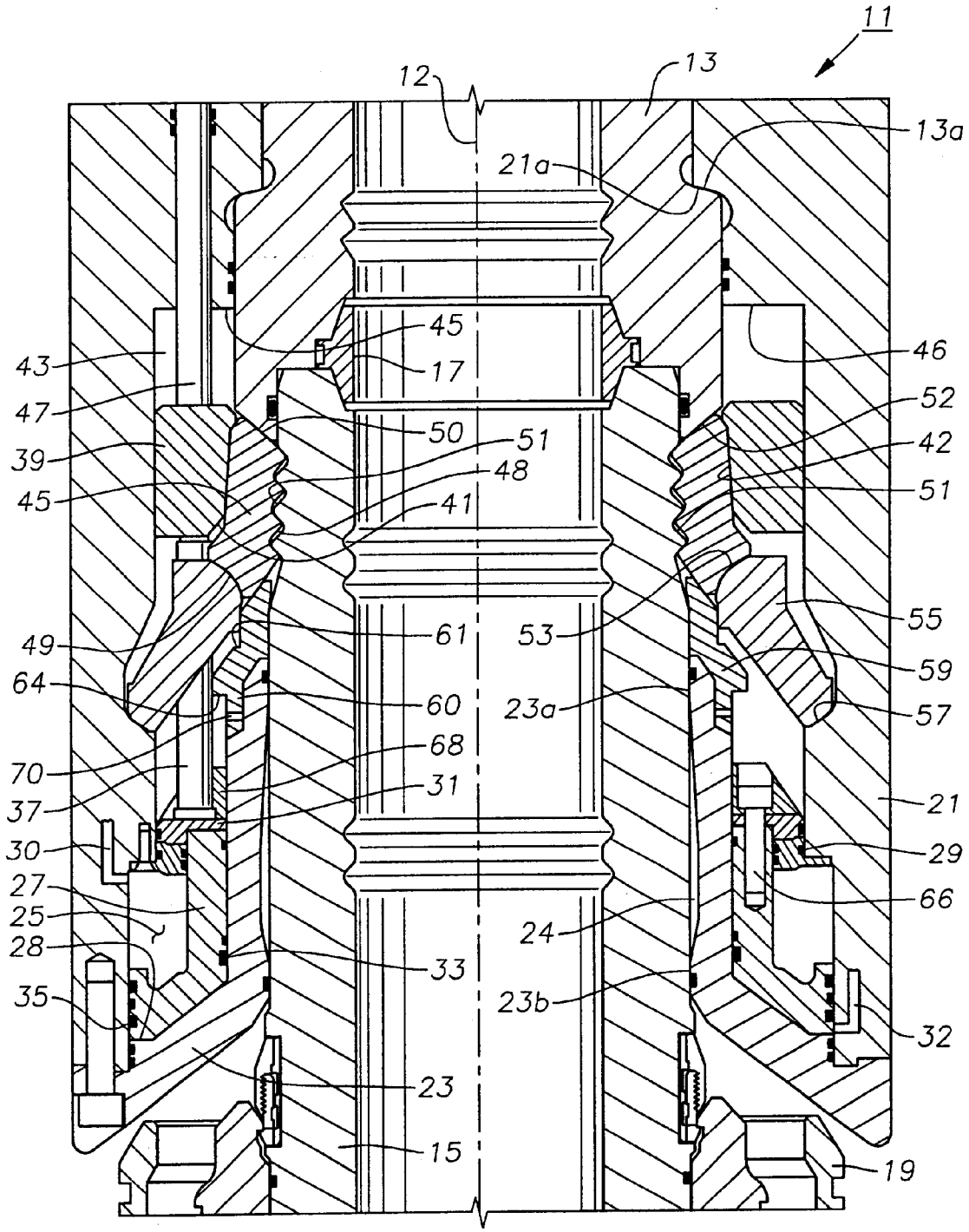
FIG. 1 is a sectional view of a tieback connector constructed in accordance with the invention, showing the tieback connector in an engaged position.

Referring to FIG. 1, an external tieback connector 11 having a central axis 12 is shown. Connector 11 is provided for connecting a conduit or riser (not shown) which extends upward to the surface to an inner wellhead housing 15. A connector body 13 is secured to the lower end of the riser and may be considered a part of the riser. An annular seal 17 is located along the inner surface of the interface between body 13 and inner wellhead housing 15. Inner wellhead housing 15 extends upward from and has a lower portion inserted in an outer wellhead housing 19.

Figure 2:
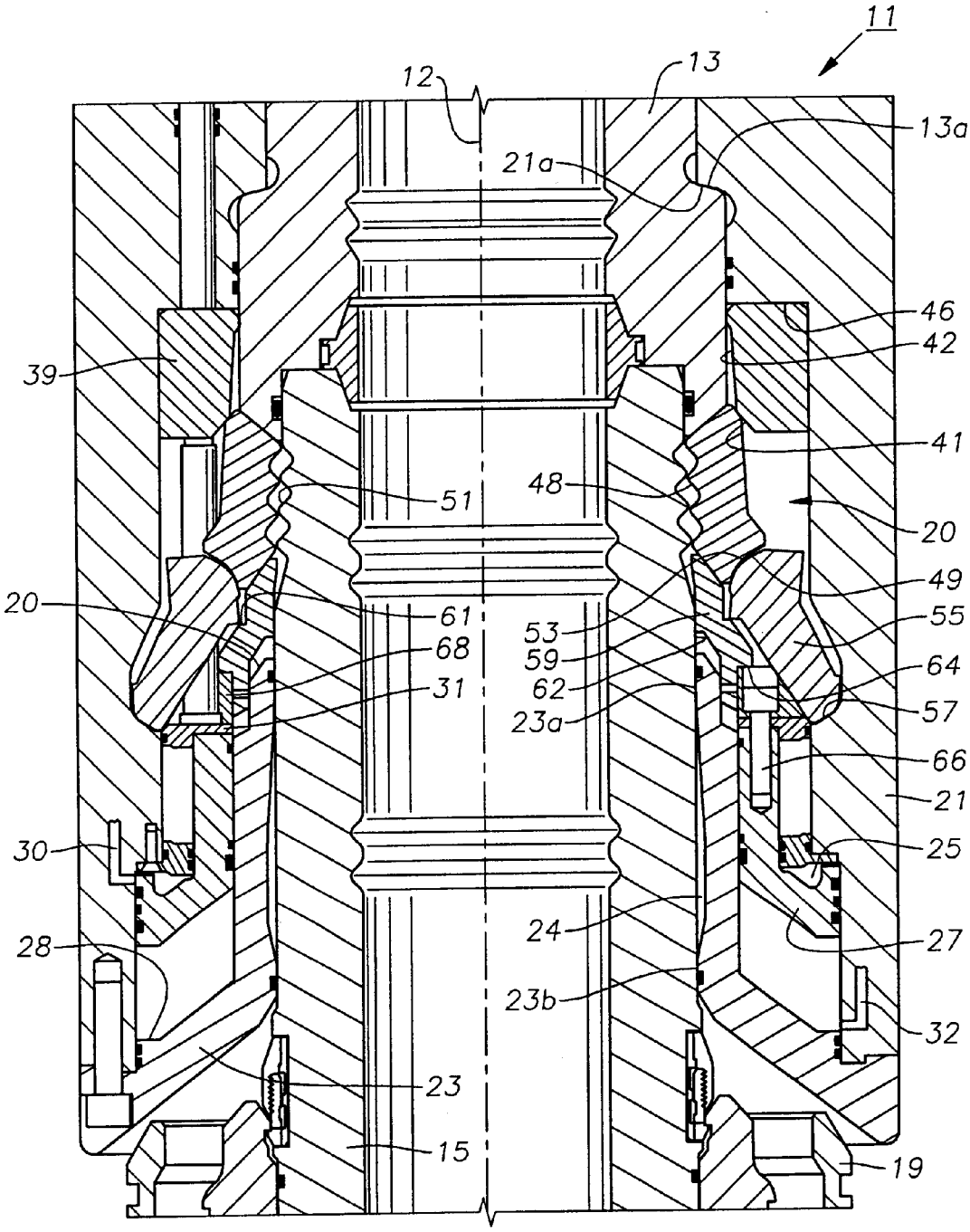
FIG. 2 is a sectional view of the tieback connector of FIG. 1, shown in a disengaged position.

Connector 11 comprises an outer tubular housing 21 and an inner tubular housing 23 which is bolted and sealed to a lower end of housing 21. Housing 21 has an internal shoulder 21*a* which lands on and is axially supported by an external shoulder 13*a* on body 13. Housing 23 slides over and contacts the outer surface of inner wellhead housing 15 at two, axially spaced-apart points 23*a* and 23*b*. A recess 24 extends between contact points 23*a*, 23*b*. An annular space or window 20 (FIG. 2) is formed between a lower end of body 13 and an upper end of housing 23, directly above contact point 23*a*.

A cavity 25 is defined at the lower end of connector 11 between housing 21 and housing 23. An annular piston 27 is located and axially reciprocated within cavity 25. In its lower position, piston 27 abuts a shoulder 28 on the inner surface of housing 23 (FIG. 1). Cavity 25 is sealed at an upper end by seals 29, 31 and is in fluid communication with ports 30 and 32 (FIG. 1). Seal 29 is mounted to housing 21 while seal 31 is axially movable with piston 27. Piston 27 also has seals 33, 35 located along its radial inner and outer surfaces, respectively.

The lower end of a piston connecting rod 37 is secured to the upper end of piston 27 for axial movement therewith. The upper end of piston connecting rod 37 is fastened to an annular cam ring 39. Cam ring 39 has a chamfer 41 on the lower end of its inner radial surface. Cam ring 39 has a tapered inner surface 42 which extends upward from chamfer 41. Cam ring 39 is axially movable in a cavity 43 between body 13 and housing 21. When in its upper position, the upper end of cam ring 39 abuts a downward-facing shoulder 46 on housing 21 ( FIG. 1). The lower end of a cam connecting rod 47 is rigidly secured to the upper end of cam ring 39. Cam connecting rod 47 extends through and is sealed to housing 21.

A plurality of segmented dogs 45 are located in window 20. The inner radial surface of cam ring 39 is designed to engage the outer radial surfaces of dogs 45. Dogs 45 have a groove profile 48 on their inner radial surfaces and a flat inclined lower end 49. Profile 48 is designed to engage an outer profile 51 on inner wellhead housing 15. Lower end 49 receives and engages a convex protuberance 53 on the upper end of a plurality of load transfer segments or members 55. Protuberance 53 is curved slightly. In one embodiment, connector 11 has one transfer member 55 for each dog 45. Each dog 45 also has an inclined upper surface 50 which engages an inclined surface 52 in window 20. Upper surfaces 50 taper downward from outside to inside on dogs 45. The lower end of each transfer member 55 is located within a concave socket 57 on the inner surface of housing 21. Transfer members 55 lean radially inward from their lower end to their upper end. Transfer members 55 pivot or rock slightly in sockets 57 when moving between the engaged and disengaged positions.

An annular release ring 59 will engage a lower end of each dog 45 to lift it out of engagement with profile 51. Release ring 59 has an inner profile which lands on an upper end of housing 23 when release ring 59 is in a lower position (FIG. 1). The upper end of release ring 59 is inclined upward and inward from outside to inside for engagement with the lower ends of dogs 45. Release ring 59 has a lower skirt 60 which is slidingly received in a slot 62 near the upper end of housing 23. Release ring 59 also has a downward-facing edge 64 on its outer surface which abuts the upper end of a polygonal ring 68 (FIG. 1) and a detent 70 on skirt 60. Polygonal ring 68 is secured to piston 27 with bolts 66.

In operation, connector 11 is attached to the lower end of the riser (not shown) and lowered onto the upper end of inner wellhead housing 15. Connector 11 is in the disengaged position with piston 27 in its upper position (FIG. 2) when connector 11 is lowered. After the rims of body 13 and housing 15 abut one another, piston 27 is hydraulically actuated to the lower position (FIG. 1) by filling cavity 25 with hydraulic fluid through port 30. As piston 27 moves downward, piston connecting rod 37 pulls cam ring 39 downward with it. The chamfer 41 on cam ring 39 contacts dogs 45 and pushes them downward and inward such that their profiles 48 begin to move into engagement with profile 51 on housing 15. Dogs 45 slide down transfer member surfaces 53 on their bottom surfaces 49.

The profiles 48 on dogs 45 are initially slightly above and misaligned with profile 51 on housing 15. As the profiles 48, 51 start to engage, dogs 45 will pull downward on body 13, thereby preloading its lower end against the upper rim on housing 15. As the lower ends of dogs 45 slide inward, an inward bias is created. The tapered inner surface 42 on cam ring 39 acts as a locking taper and allows pressure in cavity 25 to be relieved through port 32 while still holding dogs 45 in the locked position.

As shown in FIG. 1, when polygonal ring 68 moves to its lower position with piston 27, it catches detent 70 on release ring 59 to move release ring 59 to the lower position. Before piston 27 bottoms out on shoulder 28 in inner housing 23, cam ring 39 has pushed dogs 45 into full engagement with profile 51. Before dogs 45 slide into place, transfer members 55 tilt slightly inward. Due to current and wave motion at the surface, connector 11 is exposed to cyclic bending with one side being in tension while the other side is in compression. When tension is applied to one side of body 13, the upward-facing shoulders of groove profile 48 contact the lower-facing shoulders in groove profile 51 to transfer the upward force to inner wellhead housing 15. The upward force is transferred from socket 57 in housing 21 to transfer member 55 through dogs 45 to groove profile 51 on housing 15. During compressive loading, the lower rim on body 13 transfers downward load to housing 15 through the upper rim on housing 15.

Connector 11 may be disengaged by reversing these steps. Dogs 45 are disengaged from profile 51 by applying hydraulic pressure through port 32 to return cam ring 39 to its upper position ( FIG. 2). The upward movement of cam ring 39 allows dogs 45 to naturally pop out and return to their disengaged position relative to housing 15. Additionally, polygonal ring 68 pushes up on edge 64 of release ring 59 which then lifts dogs 45 upward and outward from profile 51 on housing 15. The load transfer members 55 move out of the way, thus offer little resistance to the movement of dogs 45 to the released position.

The invention has many significant advantages. There are no bolts in the load path and the components which share the load are oversized. Thus, the invention is less susceptible to fatigue failure from extended periods of cyclic loading, such as those resulting from current forces and thermal expansion. Also, it is capable of a high initial preload and resists high separation loads. Piston is fully contained within the connector and is thus protected from exposure to the harsh working environment. The compact design of the internal components allows the outer diameter of the connector to be small. In addition to hydraulic actuation, the connector can also be released mechanically using the cam connecting rod. This enables the connector to be released in the event of a hydraulic failure. Once engaged to the inner wellhead housing, the connector self locks in this position and additional force is required to release the lock. Because of his self locking, the hydraulic pressure can be released and no further additional actions are required to maintain engagement. More so, when the connector is released, the dogs are forced out of engagement and away from the inner wellhead housing to ensure a reliable release.

While the invention has been shown in only one of its forms, it should be apparent to those skilled in the art that it is not so limited, but is susceptible to various changes without departing from the scope of the invention.

We claim:

1. A subsea well connector assembly, comprising:

a first cylindrical member having a plurality of grooves formed thereon and a longitudinal axis;

a second cylindrical member concentrically located relative to the first cylindrical member;

a locking member that is radially movable relative to the longitudinal axis between an unlocked position and a locked position in engagement with the grooves;

an axially movable cam member located between the cylindrical members that engages the locking member to move the locking member between the locked and unlocked positions; and a transfer member having, an upper end portion engaging the locking member and is at an acute angle relative to a plane perpendicular to the longitudinal axis, the upper end portion having an outer edge, the transfer member having a base portion that is supported by the second cylindrical member, the base portion having an outer edge that is closer to the second cylindrical member than the outer edge of the upper end portion for transferring axial loads on the locking member through the transfer member to the second cylindrical member along a load path that is inclined relative to the longitudinal axis.

2. The assembly according to claim 1, wherein the first cylindrical member comprises a wellhead housing, and the second cylindrical member comprises a connector housing that is received over the wellhead housing.

3. The assembly according to claim 1, wherein the locking member comprises a plurality of dogs, and the transfer member comprises a plurality of links.

4. The assembly according to claim 1, wherein the upper end portion has an inner edge, and the base portion has an inner edge that is located closer to the second cylindrical member than the inner edge of the upper end portion.

5. A connector for connecting a riser from a platform to a subsea wellhead member, the wellhead member having external grooves thereon, comprising:

a connector body adapted to be joined to the riser for landing on an upper end of the well, the connector body having a longitudinal axis;

a connector housing depending concentrically from the connector body for insertion over the wellhead member;

a locking member moveably carried by the connector housing and adapted to mate with and lock in the external grooves;

a cam ring carried moveably within the connector housing to force the locking member inward into engagement with the external grooves; and a transfer member extending upward and inward from an interior portion of the connector housing, the transfer member having an upper end portion in engagement with a lower end of the locking member, the upper end portion being located at a lesser radial distance from the axis than the interior portion of the connector housing so as to define a load path that is inclined relative to the axis.

6. The connector according to claim 5, wherein an upper end of the transfer member is at an acute angle relative to a plane perpendicular to the longitudinal axis.

7. The connector according to claim 5, wherein the interior potion of the connector housing comprises an annular internal shoulder against which a lower end of the transfer member bears, the internal shoulder having an inner diameter that is greater than a maximum inner diameter of the cam ring.

8. The connector according to claim 5, wherein the upper end portion of the transfer member defines upper inner and outer diameters, and the interior portion of the connector housing defines lower inner and outer diameters, the upper inner and outer diameters differing from the lower inner and outer diameters, respectively.

9. The connector according to claim 5, wherein the upper end portion of the transfer member defines upper inner and outer diameters, and the interior portion of the connector housing defines lower inner and outer diameters, the lower inner diameter being greater than the upper outer diameter.

10. The connector according to claim 5, wherein the transfer member comprises a plurality of links.

11. The connector according to claim 5, wherein the locking member comprises a plurality of dogs and the transfer member comprises a plurality of links.

12. The connector according to claim 5, further comprising:

an axially moveable piston carried in the connector housing below the locking member and connected to the cam ring for moving the cam ring; and a release ring carried within the connector housing below the locking member and moveable with the piston for engaging the locking member as the piston moves upward to force the locking member out of engagement with the external grooves.

13. A connector for connecting a riser from a platform to a subsea wellhead housing, the wellhead housing having external grooves thereon, comprising:

a connector body adapted to be joined to the riser;

an outer housing depending from the connector body, the outer housing having an internal generally upward facing shoulder;

an inner housing concentrically joined to the outer housing and forming an annular cavity between the inner housing and the outer housing;

a locking member moveably carried in the annular cavity and adapted to mate with and lock in the external grooves;

a cam ring carried within the cavity for axial movement relative to the locking member for forcing the locking member into engagement with the external grooves; and a plurality of transfer links, each of the links having an upper end portion in engagement with the locking member and a lower end portion in engagement with the shoulder in the outer housing to transfer axial loads between the outer housing and the locking member, the upper end portion defining an inner diameter and an outer diameter, the lower end portion defining an inner diameter and an outer diameter, the inner diameter of the lower end portion being greater than the outer diameter of the upper end portion.

14. The connector according to claim 13, wherein the transfer links are located below the cam ring.

15. The connector according to claim 13, further comprising:

an axially moveable piston carried in the outer housing below the locking member and connected to the cam ring for moving the cam ring; and a release ring carried within the outer housing below the locking member and moveable with the piston for engaging the locking member as the piston moves upward to force the locking member out of engagement with the external grooves.

16. The connector according to claim 13, wherein the transfer links incline inward from the lower end portion to the upper end portion.

17. The connector according to claim 13, wherein the internal shoulder of the outer housing has an inner diameter that is greater than a maximum inner diameter of the cam member.

18. The connector according to claim 13, wherein the inner housing has a contact band protruding inward from an inner side of the inner housing for engaging the wellhead housing, the contact band being located below the locking member and separated by a recessed section of larger inner diameter than the contact band.

19. A method of joining a subsea first cylindrical member with a subsea second cylindrical member, comprising:

providing the first cylindrical member with a plurality of grooves;

positioning the second cylindrical member concentrically relative to the first cylindrical member, the second cylindrical member carrying an radially movable locking member and having a transfer member, the transfer member having, an upper end portion engaging the locking member, the upper end portion having an outer edge, the transfer member having a base portion that is supported by the second cylindrical member, the base portion having an outer edge that is closer to the second cylindrical member than the outer edge of the upper end portion;

actuating the locking member into engagement with the grooves; and transferring axial loads imposed on the locking member through the transfer member to the second cylindrical member at an acute angle relative to a plane perpendicular to a longitudinal axis of the first cylindrical member.

20. The method according to claim 19, wherein the step of providing the second cylindrical member comprises orienting the transfer member so that it inclines inwardly from a lower end portion of the transfer member to the upper end portion.

21. The method according to claim 19, wherein the step of joining the connector comprises providing the upper end portion of the transfer member with an inner edge that is closer to the first cylindrical member than an inner edge of a lower end portion of the transfer member.

* * * * *

UNITED STATES PATENT AND TRADEMARK OFFICE

CERTIFICATE OF CORRECTION

PATENT NO. : 6,293,343 B1 
DATED : September 25, 2001
INVENTOR(S) : Joseph W. Pallini, Jr. et al.

It is certified that error appears in the above-identified patent and that said Letters Patent is hereby corrected as shown below:

Column 1,
Line 20, before "subsea" delete "tie of".

Column 4,
Line 47, delete "Piston" and insert -- The piston --.
Line 57, delete "his" and insert -- this --.

Column 5,
Line 16, delete "and is".

Column 7,
Line 27, before "radially" delete "an" and insert -- a --.

Column 8,
Line 1, after "having" delete the comma ",".

Signed and Sealed this

Twenty-fifth Day of June, 2002

*Attest:*

*Attesting Officer*

JAMES E. ROGAN
*Director of the United States Patent and Trademark Office*